US006322320B1

(12) United States Patent
Pfeiffer et al.

(10) Patent No.: US 6,322,320 B1
(45) Date of Patent: Nov. 27, 2001

(54) COOLABLE CASING OF A GAS TURBINE OR THE LIKE

(75) Inventors: Christof Pfeiffer, Kussaberg (DE); Ulrich Wellenkamp, Windisch; Christoph Nagler, Zurich, both of (CH)

(73) Assignee: ABB Alstom Power (Switzerland) Ltd., Baden (CH)

( * ) Notice: Subject to any disclaimer, the term of this patent is extended or adjusted under 35 U.S.C. 154(b) by 0 days.

(21) Appl. No.: 09/450,728

(22) Filed: Nov. 30, 1999

(51) Int. Cl.[7] ..... F04D 31/00
(52) U.S. Cl. ..... 415/116
(58) Field of Search ..... 415/115, 116, 415/175, 176, 134, 139, 136, 137, 138

(56) References Cited

U.S. PATENT DOCUMENTS

| | | | | |
|---|---|---|---|---|
| 4,013,376 | | 3/1977 | Bisson et al. | 415/117 |
| 4,317,646 | * | 3/1982 | Steel et al. | 415/116 |
| 4,337,016 | * | 6/1982 | Chaplin | 415/116 |
| 4,551,064 | * | 11/1985 | Pask | 415/116 |
| 4,565,492 | * | 1/1986 | Bart et al. | 415/175 |
| 4,921,401 | * | 5/1990 | Hall et al. | 415/138 |
| 5,167,488 | * | 12/1992 | Ciokajlo et al. | 415/175 |

FOREIGN PATENT DOCUMENTS

| | | |
|---|---|---|
| 3537043 C2 | 6/1986 | (DE) . |
| 19619438A1 | 11/1997 | (DE) . |
| 0516322B1 | 12/1992 | (EP) . |

* cited by examiner

*Primary Examiner*—John E. Ryznic
(74) *Attorney, Agent, or Firm*—Burns, Doane, Swecker & Mathis, L.L.P.

(57) ABSTRACT

A coolable casing of a gas turbine or the like, with a plurality of arcuate casing segments (10) which are arranged so as to be contiguous with one another in a circumferential direction, to form an essentially closed casing ring surrounding a rotor (110), in particular of a high-pressure turbine, at least one annular casing cooling chamber (15) which is formed in the radial direction between the casing segments (10) and arcuate guide segments (30) provided with a multiplicity of passage orifices (34), at least one air guide chamber (25) which is formed in the radial direction between the guide segments (30) and at least one carrier segment (20), and at least one air supply duct (26) which is made on the carrier segment (20) and opens into the air guide chamber (25), the guide segments (30) being mounted loosely with radial play. This ensures stress-free reception, even in the case of intensive operations having high temperature gradients.

10 Claims, 2 Drawing Sheets

COOLABLE CASING OF A GAS TURBINE OR THE LIKE

BACKGROUND OF THE INVENTION

1. Field of the Invention

The invention relates to a coolable casing of a gas turbine or the like.

2. Description of the Related Art

EP 0 516 322 B1, on which the invention is based, discloses a coolable casing for a gas turbine. The casing is formed by a plurality of arcuate casing segments which, contiguous with one another in a circumferential direction, form a casing ring surrounding a rotor of a high-pressure turbine stage. For cooling the side of the casing segments which faces away from the rotor, an annular casing cooling chamber is provided, which extends in the radial direction between the casing segments and arcuate guide segments. The guide segments are formed from sheet metal portions which are provided with a multiplicity of passage orifices. There is also an air guide chamber which extends in the radial direction between the guide segments and a housing-side carrier or carrier segment. The carrier has, furthermore, an air supply duct which opens into the air guide chamber.

In order to cool the casing, cooling air is fed into the air supply duct. It passes from there through the passage orifices, high-velocity air jets being formed which impact essentially perpendicularly on the rear side of the casing segments. After impact, they are deflected, and a transverse flow is established in the casing cooling chamber.

The high cooling effect capable of being achieved by means of this device is based, in particular, on the combination of impact cooling and convection cooling. In order to utilize optimally the particularly advantageous heat transmission of the impact cooling which occurs, it is particularly important to achieve as high a velocity as possible of the cooling-air jets emerging through the passage orifices. A basic precondition for this is the establishment of as high a pressure difference as possible between the air guide chamber and the casing cooling chamber.

The leakage loss occurring due to flows around the sides of the guide segments presents a problem in this respect. In order to avoid such leakages, the individual guide segments are therefore soldered to the carrier completely and continuously. The outlay necessary for this purpose is enormous and therefore results in high production costs. Furthermore, this design also presents problems because casing segments of this kind are at great risk of being damaged, particularly where modern gas turbines with extremely high turbine inlet temperatures are concerned. If an exchange or a repair of the guide segments becomes necessary, overproportionally high costs are incurred, these being attributable, inter alia, to the associated soldering work.

This type of connection of the guide segments to the carrier also presents problems with regard to transient operations, such as, for example, during the run-up of the gas turbine or in the event of load changes, since, in these operating states, high temperature gradients may occur within the structural parts and subassemblies and may lead to high mechanical stresses. The soldered joint between the guide segments and the carrier is of particular risk under these circumstances.

The invention attempts to avoid the disadvantages described. The object on which it is based is to specify a coolable casing of the type initially mentioned, which is designed in a simple way without any serious losses of cooling efficiency, with the result that both the production costs and the repair and maintenance costs can be reduced. Furthermore, the mechanical loads occurring during the transient operations described are to be reduced and an increased useful life is thus to be achieved.

This is achieved, according to the invention, in that, in a coolable casing, the guide segments are mounted loosely and with radial play. This type of mounting makes it possible to have relative movements between the carrier or carrier segment and the casing segments. The radial play is dimensioned in such a way that an essentially unimpeded relative movement is possible, even for the most unfavorable transient operating state. The latter occurs during the run-up phase, in which the guide segments are subjected to cooling air which is at a comparatively high temperature, with the result that, by contrast, the carrier is still comparatively cold.

A particularly simple design can be implemented when the guide segments are guided loosely between the carrier and spacers, the spacers being attached to the rear side of the casing segments so as to project in the radial direction. The cooling airstream impinging onto the guide segments presses these against the spacers, thereby maintaining a permanently predetermined spacing between the guide segments and the rear side of the casing segments. The casing cooling chamber is consequently fixed in the radial direction, the radial extent of the latter corresponding to the height of the spacers. The comparatively high pressure under which the cooling air is supplied ensures that, during the time when the guide segments are subjected to cooling air, they are held pressed reliably against the spacers.

Ribs allowing the guide segments to be supported continuously along a continuous line have proved particularly appropriate as spacers. Punctiform supporting elements are also suitable, such as, for example, pins or elevations of cylindrical or conical design, which are arranged, in principle, in any desired way and thereby allow an even better equalization of the cooling effect.

A particularly reliable mounting of the guide segments can be achieved when these are provided with at least two radial webs which engage with slight axial play into corresponding guide grooves of the carrier. The slight play, on the one hand, allows the radial displacement of the guide segments and, on the other hand, minimizes the leakage losses due to the flow around the sides of the guide segments, even when the cooling air is supplied at a comparatively high excess pressure.

It is particularly beneficial to design the guide segments with a U-shaped cross-sectional profile which can be produced in a particularly simple way. By means of a noncutting forming operation, in each case legs can be formed laterally which, as webs which are continuous in a circumferential direction, ensure that the respective guide segment is guided accurately.

Preferably, the guide segments are arranged so as to overlap in a circumferential direction. This gives rise, in a circumferential direction, to a continuous uninterrupted parting plane between the casing cooling chamber and the air supply duct, so that leakage losses at the transitional points of two guide segments arranged in each case next to one another are further minimized.

An increased number of passage bores may be provided in the overlap region, in order to make the formation of cooling-air jets in sufficient quantity available even in this region. This takes into account the effect that, due to the loose mounting of the individual guide segments, relative assignment may vary in a circumferential direction, together with the risk that, in the overlap region, too few passage bores of two overlapping guide segments come into congruence.

It is, of course, also possible, instead of an increased number of passage bores, to provide in the overlap region, in each case in one of the two guide segments, passage orifices with an enlarged cross section in a circumferential direction, so that the passage bores remain free, irrespective of the relative position of two adjacent guide segments which is momentarily assumed.

Flange portions running in the circumferential direction are provided in the contact region in each case between the casing segment and carrier, so that the casing segment and carrier are releasably connected to one another by means of holding clamps which engage round the flange portions in each case contiguous with one another. The holding clamps, on the one hand, press the casing segments and carrier firmly against one another, so that leakage losses due to cooling air emerging between the two structural parts is largely prevented. On the other hand, the holding clamps make it possible to release and restore the connection in a simple way, so that not only the mounting of the casing, but, to a particular extent, also repair are greatly simplified by the exchange of individual elements.

Additional sealing elements between the holding clamps, on the one hand, and the flange portions, on the other hand, ensure virtually complete sealing off in the contact region between the casing segment and carrier. The cooling-air requirement can consequently be kept at a low level.

BRIEF DESCRIPTION OF THE DRAWINGS

An exemplary embodiment of the invention is illustrated in the drawing with reference to a coolable casing on the first rotor of a high-pressure turbine stage.

In the drawing.

Only the elements essential for understanding the invention are shown.

DETAILED DESCRIPTION OF THE PREFERRED EMBODIMENTS

Figure 1:
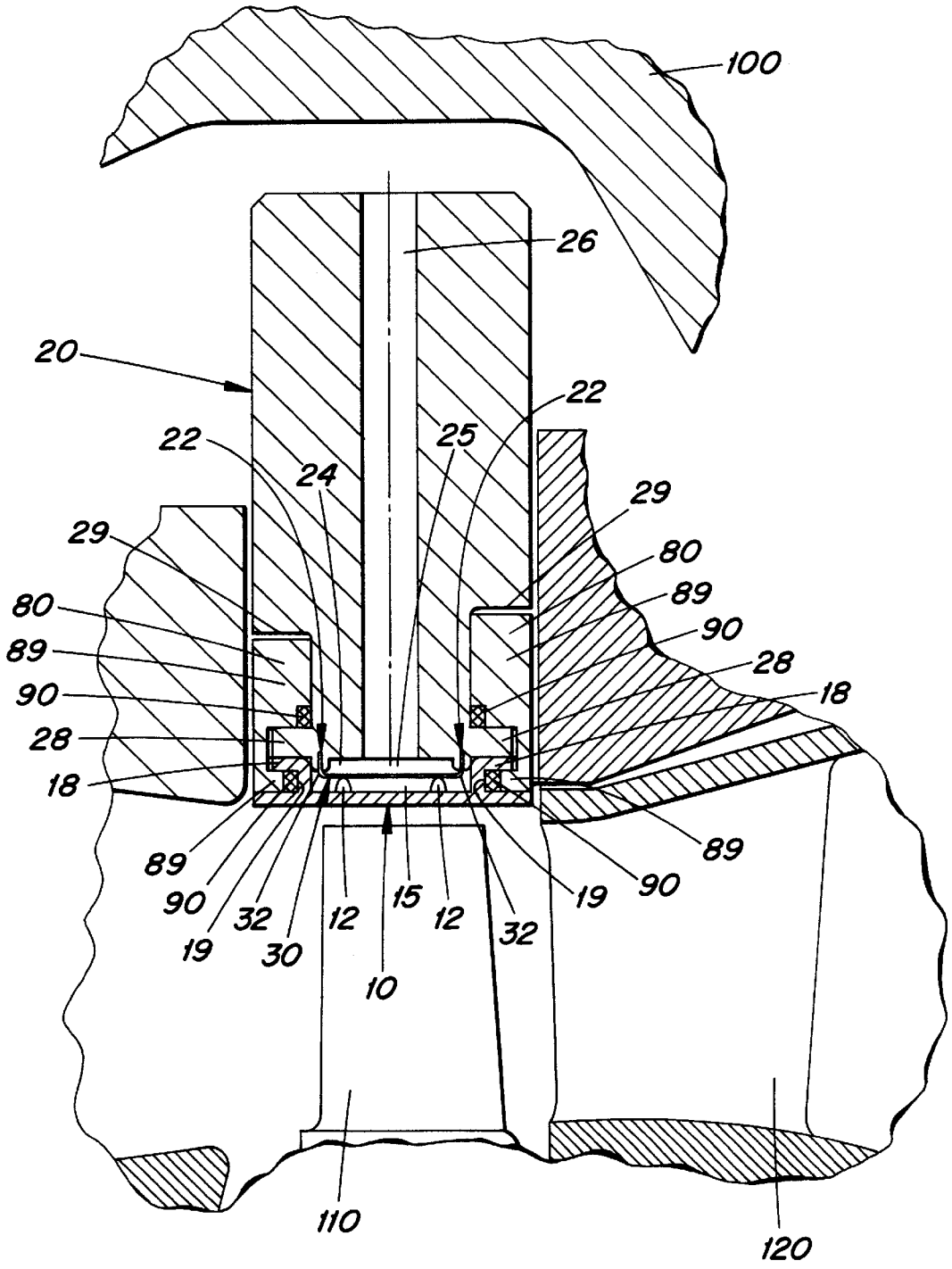
FIG. 1 shows a coolable casing in axial section (part view)

The design, on which the invention is based, of a coolable casing may be gathered, in particular, from FIG. 1. It illustrates a detail of the first high-pressure turbine stage of a gas turbine, consisting of a rotor 110 and of a guide wheel 120. The rotor 110 is surrounded in the radial direction by a casing ring which is composed of a plurality of casing segments 10 lined up with one another in a circumferential direction.

Each casing segment 10 is assigned to a carrier segment 20 which is fixed to a housing 100 in a way not illustrated in any more detail. The carrier segment 20 has passing through it essentially in the radial direction an air supply duct 26, through which cooling air is supplied from a cooling-air supply not illustrated in any more detail. For example, a part airstream from one of the preceding compressor stages is used as cooling air. The air supply duct 26 opens into a depression 24 which is continuous in a circumferential direction and which is part of an air guide chamber 25 which is delimited radially on the inside by a guide segment 30. The guide segment 30 has a U-shaped basic form, with two webs 32 which engage into correspondingly shaped guide grooves 22 of the carrier segment 20.

On the opposite side, the guide segment 30 is supported on two spacers 12 which are designed as ribs and which are attached to the rear side of the casing segment 10 so as to run in the circumferential direction and to project in the radial direction. A casing cooling chamber 15 is thus obtained in the radial direction between the casing segment 10 and the guide segment 30.

Figure 2:
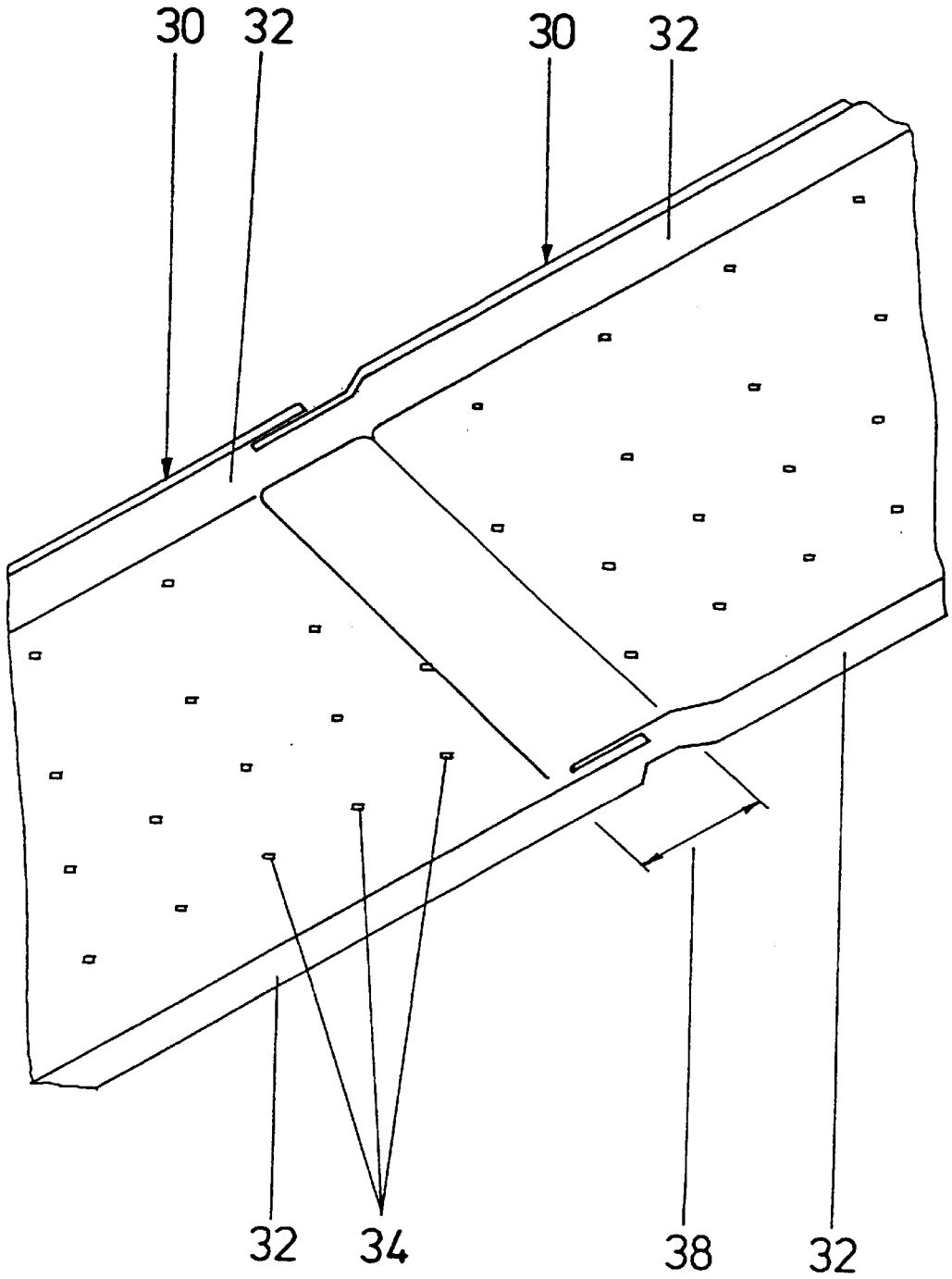
FIG. 2 shows a perspective view of the overlap region of two guide segments contiguous with one another.

As may be gathered, in particular, from FIG. 2, the guide segments 30 are provided with a multiplicity of passage orifices 34 which constitute a fluid connection between the air guide chamber 25 and the casing cooling chamber 15 and which serve for the formation of cooling-air jets.

The carrier segment 20 and the casing segment 10 have respectively flange portions 28 and 18 which are surrounded by holding clamps 80 and consequently connect the carrier segment 20 and the casing segment 10 to one another. The holding clamps 80 have an approximately U-shaped cross-sectional profile, with two axial webs 89 which engage into corresponding axial grooves 29, 19 of the carrier segment 20 and of the casing segment 10 respectively. An axially aligned transition from the carrier segment 20 to the casing segment 10 is thereby obtained.

Sealing elements 90 are inserted in corner regions between the holding clamps 80, on the one hand, and the flange portions 28 of the carrier segment 20 and the flange portions 18 of the casing segment 10, on the other hand, in order to ensure a largely pressure-tight seal between the air-guiding regions, in particular the casing cooling chamber 15 and the air guide chamber 25, and the surroundings.

In the circumferential direction, the guide segments 30 are arranged so as to overlap, in order to form air-guiding ducts which are continuous in the circumferential direction. As may be gathered from FIG. 2, in each case two guide segments 30 butting one against the other are arranged in such a way that an overlap region 38 is obtained. For this purpose, the guide segments 30 are in each case shaped at one end in such a way that they can be pushed into the adjacent guide segment 30. To this effect, the outer contour is set back inward slightly, so that a kind of guide is obtained in the transitional region 38.

The particular feature of the present design is, then, that the guide segments 30 are mounted loosely with some radial play and a relative movement between the carrier segment 20 and the guide segment 30 thus becomes possible. This relative movement makes it possible, in particular, to have a stress-free compensation of differing thermal expansion in the case of transient operating states, such as, for example, in the run-up of the gas turbine, during which states the structural parts have different temperatures. In the case of a starting phase, the carrier segment 20 is still cold (for example, at ambient temperature), whereas the guide segment 30 is already highly heated by cooling air of higher temperature from one of the compressor stages.

The cooling air supplied by the air guide duct 26 acts on the guide segment 30 and presses the latter radially inward against the ribs 12 of the casing segment 10. Due to a permanent supply of cooling air, a pressure difference between the air guide chamber 25 and the casing cooling chamber 15 is maintained, so that the guide segment 30 is fixed reliably during operation. Furthermore, it is necessary to maintain the pressure difference in order to achieve the desired impact cooling by means of cooling-air jets which are generated by the passage orifices 34.

In order to avoid leakage losses due to a flow around the sides of the guide segments 30 in the region of the webs 32, it is necessary for the axial play of the webs 32 in the corresponding guide grooves 22 to be dimensioned so as to be as narrow as possible.

It becomes clear, furthermore, that, because of the loose mounting of the individual guide segments 30, relative movement in the circumferential direction may also occur between the individual guide segments 30. The overlap region 38 must therefore be dimensioned in such a way that some relative movements become possible. Expediently, therefore, additional passage orifices are provided (not illustrated in FIG. 2) in the overlap region 38, in order to ensure the formation of cooling-air jets even in this region.

What is claimed is:

1. A coolable casing of a gas turbine, comprising:

a plurality of arcuate casing segments which are arranged so as to be contiguous with one another in a circumferential direction, to form an essentially closed casing ring surrounding a rotor, in particular of a high-pressure turbine, at least one annular casing cooling chamber which is formed in the radial direction between the casing segments and arcuate guide segments provided with a multiplicity of passage orifices, at least one air guide chamber which is formed in the radial direction between the guide segments and at least one carrier segment, and at least one air supply duct which is made on the carrier segment and opens into the air guide chamber, wherein the guide segments are mounted loosely with radial play.

2. The casing as claimed in claim 1, wherein the guide segments are guided loosely between the carrier segment and spacers which are attached to the rear side of the casing segments so as to project in the radial direction.

3. The casing as claimed in claim 2, wherein spacers are in the form of webs, ribs, pins or supporting elevations.

4. The casing as claimed in claim 1, wherein the guide segments have radial webs which are guided with slight axial play in guide grooves of the carrier segment.

5. The casing as claimed in claim 1, wherein the guide segments have a U-shaped cross-sectional profile.

6. The casing as claimed in claim 1, wherein the guide segments are arranged so as to overlap in a circumferential direction.

7. The casing as claimed in claim 6, wherein the guide segments have an increased number of passage orifices in the overlap region.

8. The casing as claimed in claim 6, wherein the guide segments have passage orifices or enlarged area in the overlap region.

9. The casing as claimed in claim 1, wherein the casing segments and the carrier segments have flange portions pointing in the axial direction and are releasably connected to one another by means of holding clamps engaging round the flange portions.

10. The casing as claimed in claim 9, wherein sealing elements are disposed between the holding clamps and the flange portions.

* * * * *